US012510272B2

(12) United States Patent
Wölk et al.

(10) Patent No.: US 12,510,272 B2
(45) Date of Patent: Dec. 30, 2025

(54) REFRIGERANT RECEIVER

(71) Applicant: MAHLE INTERNATIONAL GMBH, Stuttgart (DE)

(72) Inventors: Gerrit Wölk, Stuttgart (DE); Holger Ulrich, Korntal-Münchingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 93 days.

(21) Appl. No.: 18/410,356

(22) Filed: Jan. 11, 2024

(65) Prior Publication Data

US 2024/0240842 A1 Jul. 18, 2024

(30) Foreign Application Priority Data

Jan. 13, 2023 (DE) ..... 102023200251.5

(51) Int. Cl.
*F25B 41/40* (2021.01)

(52) U.S. Cl.
CPC ..... *F25B 41/40* (2021.01); *F25B 2400/16* (2013.01)

(58) Field of Classification Search
CPC ..... F25B 41/40; F25B 43/003; F25B 43/006; F25B 45/00; F25B 2400/16
See application file for complete search history.

(56) References Cited

U.S. PATENT DOCUMENTS 5,191,775 A * 3/1993 Shiina ..... B21D 26/14 62/503
6,615,608 B1 * 9/2003 Telesz ..... F25B 43/003 62/509
2016/0052365 A1 * 2/2016 Kohigashi ..... B60H 1/00921 62/278

FOREIGN PATENT DOCUMENTS

| | | |
|---|---|---|
| JP | S60-159976 U | 10/1985 |
| JP | S61-62771 | 3/1986 |
| JP | H05-12681 Y2 | 4/1993 |
| JP | 8313118 A * | 11/1996 |
| JP | H10-332229 | 12/1998 |
| JP | H11-94401 | 4/1999 |
| JP | 2000-097524 | 4/2000 |
| JP | 2018-128202 | 8/2018 |
| JP | 2020-165600 | 10/2020 |

OTHER PUBLICATIONS

German Search Report issue in DE102023200251.5 (Dec. 12, 2023).

* cited by examiner

*Primary Examiner* — Marc E Norman
(74) *Attorney, Agent, or Firm* — Barnes & Thornburg LLP

(57) ABSTRACT

The invention relates to a refrigerant receiver, comprising
a refrigerant container,
a first refrigerant channel, which is connected to the container,
wherein at least the container and first fluid channel are formed as an integral unit.
This makes it possible to produce a less expensive refrigerant receiver that can also be operated with refrigerants requiring high pressures, because the integral design can withstand high operating pressures.

9 Claims, 2 Drawing Sheets

REFRIGERANT RECEIVER

CROSS-REFERENCE TO RELATED APPLICATIONS

This application claims priority from German Patent Application No. 10 2023 200 251.5, filed Jan. 13, 2023 the entirety of which is hereby fully incorporated by reference.

The present invention relates to a refrigerant receiver. The invention also relates to a thermal module and a motor vehicle that contains such a refrigerant receiver.

Refrigerant receivers are used in modern temperature control units, e.g. air conditioners or cooling units, in particular in electric vehicles, and form reservoirs for refrigerants. To be able to supply the refrigerant stored in the refrigerant receiver to a refrigerant circuit, the refrigerant receiver is connected to the refrigerant circuit with refrigerant channels, which can contain a compressor and an evaporator. These fluid channels are connected to the refrigerant receiver with a mechanical or material bonding, e.g. by welding the fluid channel to the refrigerant receiver.

Because of the increasingly stricter environmental standards, alternative refrigerants such as carbon dioxide (R744) are receiving more attention, in particular because $CO_2$ is not only an effective refrigerant, but is also non-flammable, and does not decompose. It is also extremely inexpensive throughout the world and does not pollute the environment.

The disadvantage with the use of refrigerants that must be pressurized, such as $CO_2$, is that pressures may exceed 30 bar, requiring that the components in the refrigerant circuit, in particular the container in the refrigerant receiver, are designed to withstand these pressures. With the refrigerant receivers from the prior art, in which the fluid channels are welded to the containers in the refrigerant receivers, these welds form a weakness over time that are prone to leakage, rendering the refrigerant receivers unusable. Mechanical connections between the fluid channels and the containers in the refrigerant receivers are structurally complex and therefore expensive.

The present invention therefore addresses the problem of creating an improved, or at least alternative design for a refrigerant receiver, which can also be used with refrigerants at higher pressures, without involving higher costs.

This problem is solved according to the invention by the subject matter of independent claim 1. Advantageous embodiments are the subject matter of the dependent claims.

The present invention is based on the general idea that it is possible to produce a refrigerant container for a conventional refrigerant receiver and a first fluid channel connected thereto as an integral unit, thus avoiding all the known disadvantages of a weld or mechanical connection. The refrigerant receiver comprises the aforementioned container for storing refrigerant, and at least one refrigerant channel that opens into the container. The container and this first fluid channel are formed as an integral unit for this. This results in a container with at least one (first) fluid channel without the previously necessary materially bonded or mechanical connection, such that the refrigerant receiver as a whole is not only less expensive to produce, but is also significantly less prone to leakage. This design can also be used in particular with pressurized refrigerants, in particular $CO_2$, such that the advantages associated therewith can also be obtained.

In an advantageous development of the refrigerant receiver according to the invention, the container and first fluid channel are produced in molds, in particular using aluminum die casting processes. Any appropriate molding process can be used in which a solid element can be obtained from an amorphous substance. Some of these involve molding liquid substances, e.g. gravity casting, die casting, low pressure casting, or centrifugal casting, as well as molding processes for a plastic, e.g. injection molding, compression molding, transfer molding, extrusion, blow molding, etc. All of these processes share the advantage that both the container as well as at least one first fluid channel can be formed as an integral unit, without additional material bonding or a mechanical connection.

A particularly preferred means of producing the container and first fluid channel with a molding process is aluminum die casting. This involves forcing liquid or soft aluminum into a preheated steel mold at high pressure. Aluminum die casting has the advantage that metal parts can be produced quickly, with high surface quality. At the same time, aluminum die casting has the advantage that components can be mass produced at lower unit costs.

The first fluid channel has a connection contour. This connection contour can be a threading or some other contour with which another component such as a gauge and/or valve can be connected thereto. This connection contour can also be formed when molding the container and the first fluid channel, resulting in minimal post-processing as a result of the high surface quality obtained with aluminum die casting.

In an advantageous development of the refrigerant receiver according to the invention, a gauge and/or valve is connected to the connection contour. The gauge can be pressure sensor, and the valve can be for distributing the refrigerant flow in the refrigerant circuit. This valve can also be an expansion valve.

In another advantageous embodiment of the refrigerant receiver according to the invention there is at least one more refrigerant channel on the container, which can also be formed integrally thereon. In the best case, not only the container and first fluid channel, but also the at least one other channel are formed in a molding process, i.e. as a single unit, in particular through casting, such that there is no need for an additional connection of the at least one other fluid channel, e.g. with a weld that is prone to leaking and/or a structurally complicated and therefore expensive mechanical connection. This is of particular advantage in particular for refrigerant receivers in which pressurized carbon dioxide (R744) is used as the refrigerant.

In a particularly preferred embodiment, the at least one other fluid channel is connected to the first fluid channel and/or the container. The at least one other, e.g. a second fluid channel, is therefore part of the refrigerant circuit and can form a return line or a supply line.

Ideally, there is an attachment contour, which is formed as an integral part of the container. The attachment contour can also be formed when molding the container with the first fluid channel, i.e. in the same molding process, e.g. aluminum die casting, such that there is no need for a mechanical or material bonded connection of the attachment contour to the container, thus eliminating the associated costs. Other components can be attached to the container with this attachment contour.

In another advantageous embodiment, the refrigerant receiver has a desiccant cartridge that functions as a choke, for example. In particular when first starting up the refrigerant receiver, the drying agent in the desiccant cartridge binds the moisture that gets in when filling the refrigerant circuit with refrigerant. This desiccant cartridge can also have a filter that keeps contaminants out of the refrigerant. By dehumidifying the liquid refrigerant it is possible to eliminate air pockets as well as contaminants from the liquid refrigerant, thus increasing the effectiveness of a thermal module with this type of refrigerant receiver, e.g. a cooling unit or air conditioner.

The present invention is also based on the general concept of a thermal module equipped with the refrigerant receiver described above, such that the thermal module also has the advantages obtained therewith. Specifically, this results in a less expensive production approach, because the individual fluid channels and any connection or attachment contours no longer have to be retroactively connected to the container for the refrigerant in the thermal module, but instead can already be produced as integral parts of the container during the production thereof, e.g. in a molding process. This also significantly increases the sealing properties of the system, such that the refrigerant receiver and therefore the thermal module according to the invention can be used in particular with $CO_2$ (R774), or any other conventional refrigerant.

The present invention is also based on the general concept of equipping a motor vehicle, in particular an electric vehicle, with the refrigerant receiver or thermal module described above. This results in the same advantages for the motor vehicle, in particular for an electric vehicle, that are obtained through the reduced production costs for the thermal module and refrigerant receiver. At the same time, a refrigerant circuit in the electric vehicle can be operated using $CO_2$ when the thermal module according to invention is used, which also has positive effects with regard to the environment and production costs.

Further important features and advantages of the invention can be derived from the dependent claims, drawings, and the description in reference to the drawings.

It should be clear that the features specified above and explained below can be used not only in the given combinations, but also in other combinations or in and of themselves, without abandoning the scope of the present invention. Components of a higher level unit specified above and in the following, e.g. a device, apparatus or assembly, that are indicated separately, can form separate parts or components of this unit or be integral parts or sections thereof, even if they are not shown as such in the drawings.

Preferred exemplary embodiments of the invention are shown in the drawings and shall be explained in greater detail below, in which the same reference symbols are used for the same, similar, or functionally similar components.

Therein, schematically:

Figure 1:
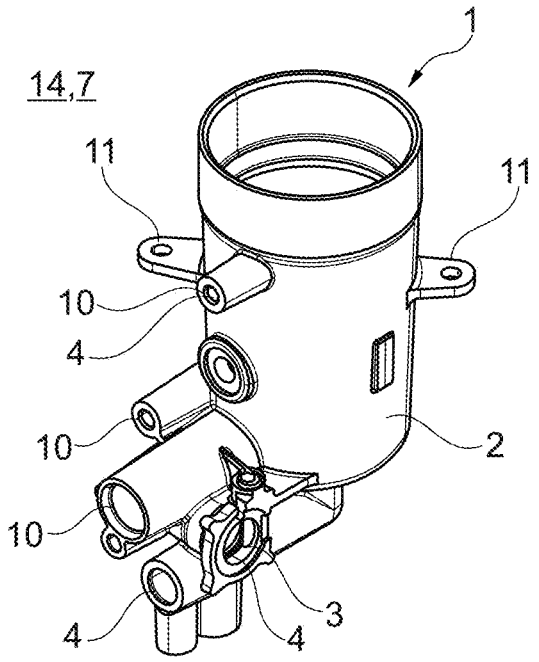
FIG. 1 shows an illustration of a refrigerant receiver according to the invention.
Figure 2:
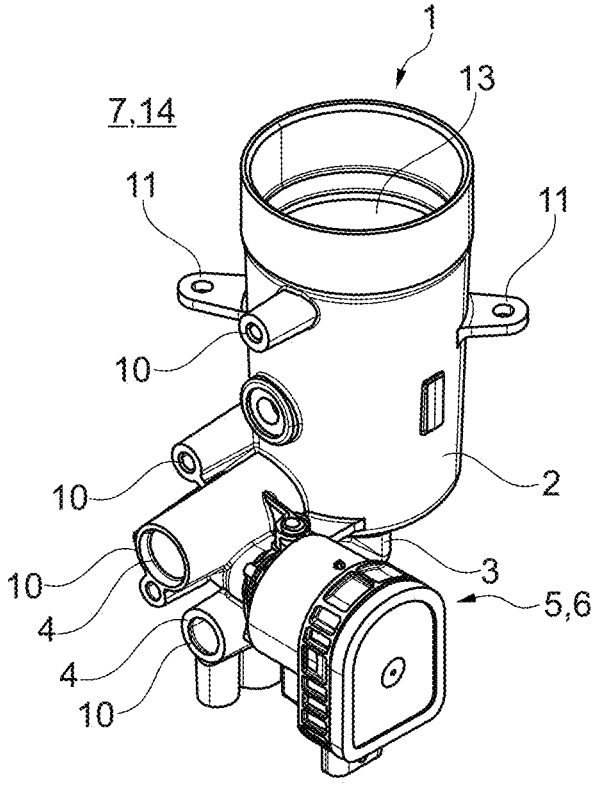
FIG. 2 shows the same refrigerant receiver shown in FIG. 1, but with a valve.
Figure 3:
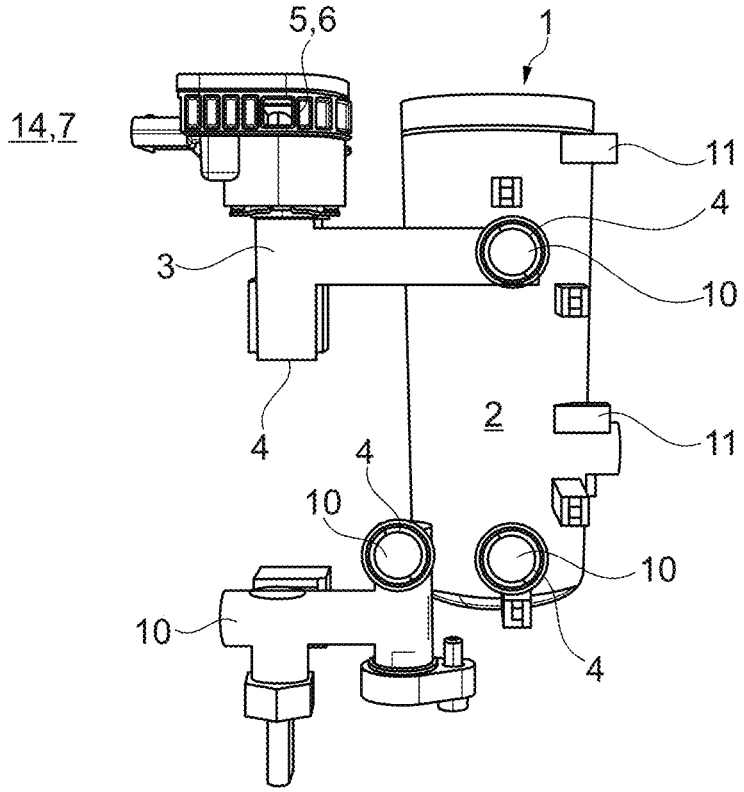
FIG. 3 shows another embodiment of the refrigerant receiver according to the invention, with the valve connected thereto.
Figure 4:
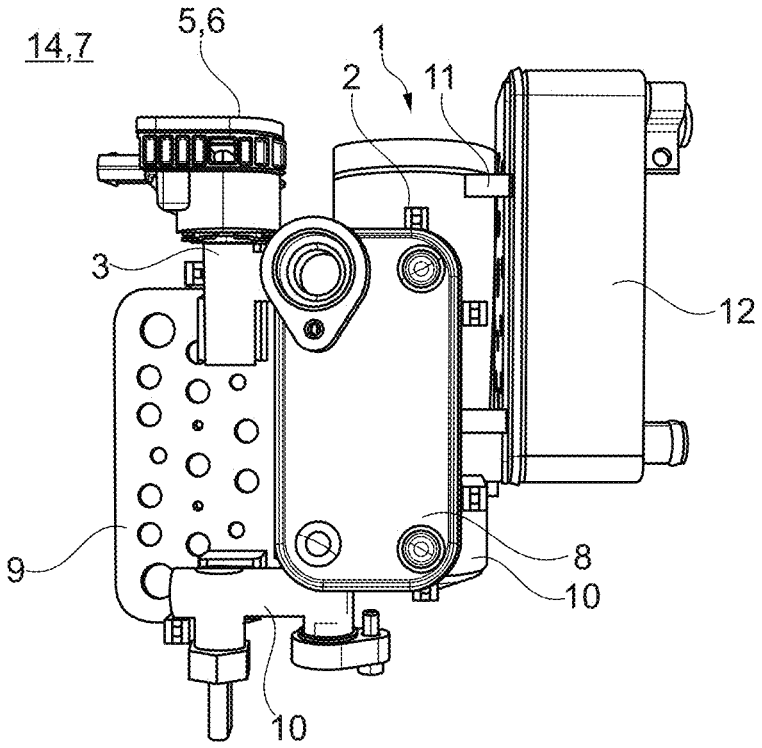
FIG. 4 shows the same assembly shown in FIG. 3, but with a heat exchanger and cooler attached thereto.

As shown in FIGS. 1 to 4, the refrigerant receiver 1 according to the invention contains a container 2 for receiving refrigerant, and a first refrigerant channel 3, which is connected to the container 2. The container 2 and first fluid channel 3 form an integral unit obtained with a molding process, in particular aluminum die casting. The first fluid channel 3, which is connected to the container 2 at a first end, has a connection contour 4 on its second end, to which a gauge 5 and/or valve 6, e.g. an expansion valve, are connected (see FIGS. 2 and 3). The same component is indicated by the reference numerals 5 and 6 in FIGS. 2 and 3, which can refer to either a gauge 5 or a valve 6, or a heat exchanger 8. This heat exchanger 8 is shown in FIG. 4. A chiller 9 can also be connected to this connection contour 4 (see FIG. 4).

FIGS. 1 to 4 also show that there is at least one more refrigerant channel 10, which is also formed as an integral unit with the container 2. This can also be formed in a molding process, in particular aluminum die casting.

The at least one other fluid channel 10 is connected to the first fluid channel 3 and/or the container 2 in the refrigerant receiver 1, and embedded in a refrigerant circuit.

The connection contour 4 can also be formed on the at least one other fluid channel 10, in particular as an integral part of the fluid channel in question 3, 10. This connection contour 4 is preferably an inner thread formed as an integral part of the fluid channel 3, 10 and the container 2, e.g. by means of a molding process. Other components 12, in particular a gauge 5, valve 6, heat exchanger 8, or chiller 9 can be relatively easily connected thereto by this means, obtaining a nevertheless more reliable seal.

The container 2 can also have an attachment contour 11 with which the refrigerant receiver, specifically the container 2, can be attached to another component 12 (see FIG. 4), or with which the other component 12 can be attached to the container 2. This attachment contour 11, or the other component 12 can also be formed integrally with the container 2 in a molding process, i.e. from a single piece, which has the major advantage that it is not necessary to subsequently attach the attachment contour 11 to the container 2, thus simplifying the assembly process and reducing production costs.

The refrigerant receiver 1 can also contain a desiccant cartridge 13, in particular in the container 2, which dries the refrigerant, thus increasing the efficiency of the refrigerant and therefore the refrigerant receiver 1 using this refrigerant. The refrigerant receiver 1 according to the invention can be used in a thermal module 14 used for controlling a refrigerant circuit in a motor vehicle 7, in particular an electric vehicle.

On the whole, the previously necessary connecting of the at least one fluid channel 3, 10 to a container 2 in the refrigerant receiver 1, in particular with a mechanical attachment or material bonding, in particular welding, is no longer necessary with the refrigerant receiver 1 according to the invention, thus reducing assembly costs for the refrigerant receiver 1 according to the invention.

It is particularly advantageous that because there are no welding seams, potential weaknesses can be eliminated which have previously made it difficult to use refrigerants that require higher operating pressures, e.g. $CO_2$. The refrigerant receiver 1 according to the invention allows for the use of any refrigerant, in particular $CO_2$ (R774), resulting in a more efficient and ecological operation of the refrigerant receiver 1 and a thermal module 14 equipped therewith, or a motor vehicle 7 containing the thermal module 14.

The specification can be best understood with reference to the following Numbered Paragraphs:

Numbered Paragraph 1. A refrigerant receiver (1), comprising
- a refrigerant container (2),
- a first refrigerant channel (3), which is connected to the container (2),
- wherein at least the container (2) and first fluid channel (3) are formed as an integral unit.

Numbered Paragraph 2. The refrigerant receiver according to Numbered Paragraph 1, characterized in that the container (2) and first fluid channel (3) are produced with a molding process, in particular aluminum die casting.

Numbered Paragraph 3. The refrigerant receiver according to Numbered Paragraph 2, characterized in that a connection contour (4) is formed on the first fluid channel (3).

Numbered Paragraph 4. The refrigerant receiver according to Numbered Paragraph 3, characterized in that at least a gauge (5), valve (6), heat exchanger (8), chiller (9), or component (12) is connected to the connection contour (4).

Numbered Paragraph 5. The refrigerant receiver according to any of the preceding Numbered Paragraphs, characterized in that there is at least one other fluid channel (10) for refrigerant, at least the container (3) and at least one other fluid channel (10) are formed as an integral unit.

Numbered Paragraph 6. The refrigerant receiver according to Numbered Paragraph 5, characterized in that the at least one other fluid channel (10) is connect to the first fluid channel (3) and/or container (2).

Numbered Paragraph 7. The refrigerant receiver according to Numbered Paragraph 5 or 6, characterized in that at least the container (2) and other fluid channel (10) are produced in a molding process, in particular aluminum die casting.

Numbered Paragraph 8. The refrigerant receiver according to any of the preceding Numbered Paragraphs, characterized in that there is an attachment contour (11), which is formed as an integral part of the container (2).

Numbered Paragraph 9. The refrigerant receiver according to Numbered Paragraph 8, characterized in that at least the container (2) and the attachment contour (11) are produced using a molding process, in particular aluminum die casting.

Numbered Paragraph 10. The refrigerant receiver according to any of the preceding Numbered Paragraphs, characterized in that the refrigerant receiver (1) contains a desiccant cartridge (13).

Numbered Paragraph 11. A thermal module (14) containing a refrigerant receiver (1) according to any of the preceding Numbered Paragraphs.

Numbered Paragraph 12. A motor vehicle (7) containing a refrigerant receiver (1) according to any of the Numbered Paragraphs 1 to 10, or a thermal module (14) according to Numbered Paragraph 11.

Numbered Paragraph 13. The motor vehicle according to Numbered Paragraph 12, characterized in that the motor vehicle (7) is an electric vehicle.

The invention claimed is:

1. A refrigerant receiver, comprising a refrigerant container, a first refrigerant channel, which is connected to the container, and at least one other fluid channel for refrigerant, the at least one other fluid channel being connected to either the refrigerant container or the first refrigerant channel, wherein at least the refrigerant container, first refrigerant channel, and the at least one other fluid channel are an integral unit, wherein the refrigerant container, the first refrigerant channel, and the at least one other fluid channel are a single piece that is made from aluminum.

2. The refrigerant receiver according to claim 1, wherein a connection contour is formed on the first refrigerant channel.

3. The refrigerant receiver according to claim 2, wherein at least one of a gauge, a valve, a heat exchanger, a chiller, or a component is connected to the connection contour.

4. The refrigerant receiver according to claim 1, wherein the refrigerant container further comprises an attachment contour, wherein the attachment contour is a part of the integral unit with the refrigerant container.

5. The refrigerant receiver according to claim 1, further comprising a desiccant cartridge, wherein the desiccant cartridge is received within the integral unit.

6. A thermal module containing a refrigerant receiver according to claim 1.

7. A motor vehicle containing a thermal module according to claim 6.

8. A motor vehicle containing a refrigerant receiver according to claim 1.

9. The motor vehicle according to claim 8, wherein the motor vehicle is an electric vehicle.

* * * * *